United States Patent [19]

Brenner et al.

[11] Patent Number: 4,478,130

[45] Date of Patent: Oct. 23, 1984

[54] ARRANGEMENT FOR SLIPPER CAVITATION EROSION CONTROL AND IMPACT REDUCTION

[75] Inventors: Kenneth I. Brenner; Joseph F. Wollschlager, both of Rockford, Ill.

[73] Assignee: Sundstrand Corporation, Rockford, Ill.

[21] Appl. No.: 245,478

[22] Filed: Mar. 19, 1981

[51] Int. Cl.[3] ..... F01B 13/04

[52] U.S. Cl. ..... 91/6.5; 91/499

[58] Field of Search ..... 417/203, 312; 91/6.5, 91/488, 499

[56] References Cited

U.S. PATENT DOCUMENTS

| | | | |
|---|---|---|---|
| 2,780,170 | 2/1957 | Stoyke et al. | 417/203 |
| 3,066,609 | 12/1962 | Hann | 91/488 |
| 3,319,575 | 5/1967 | Havens | 91/488 |
| 3,585,901 | 6/1971 | Moon, Jr. | 91/6.5 |
| 3,616,726 | 11/1971 | Ruger | 91/490 |
| 3,690,789 | 9/1972 | Spence | 417/203 |
| 3,847,057 | 11/1974 | Ital | 91/6.5 |
| 4,007,663 | 2/1977 | Nagatomo | 91/6.5 |

FOREIGN PATENT DOCUMENTS

| | | | |
|---|---|---|---|
| 256977 | 4/1962 | Australia | 91/505 |
| 2253419 | 5/1974 | Fed. Rep. of Germany | 91/488 |
| 6080 | 1/1981 | Japan | 417/312 |
| 1268203 | 3/1972 | United Kingdom | 91/499 |
| 1340793 | 12/1973 | United Kingdom | 91/488 |
| 422862 | 12/1974 | U.S.S.R. | 91/499 |

*Primary Examiner*—William L. Freeh

*Attorney, Agent, or Firm*—Harold A. Williamson; Ted E. Killingsworth; Michael B. McMurry

[57] ABSTRACT

This invention relates to a slipper and swashplate cavitation erosion control and impact reduction assembly for a piston type hydraulic apparatus that includes a rotating cylinder block having at least one axially disposed bore. A piston is mounted for reciprocal movement within the bore. A fixed port plate is provided as well as a pair of different fluid pressure sources. The port plate cooperates with the rotating cylinder block to deliver alternately during two discrete and different portions of the cylinder block rotation first one of the fluid pressure sources and then the other of the fluid pressure sources to the bore and the piston. The piston has at one end thereof a slipper coupled thereto and the slipper is mounted for a sliding interface movement on a surface of a swashplate. The swashplate is nonrotatable in respect of the port plate. The piston has an internal passage extending from one end of the piston to the other end of the piston to thereby allow fluid under alternate pressure to be delivered to and through an opening in the slipper to the interface between the slipper and said swashplate. The inventive improvement resides in the swashplate being provided with at least one vent passage. The vent passage has one end thereof opening at the swashplate surface and the slipper-swashplate interface and the other end of said vent passage opening to an environment in which the ambient pressure is lower than either of the fluid pressure sources to thereby reduced erosion and load impact effects at the slipper-swashplate interface.

4 Claims, 6 Drawing Figures

ARRANGEMENT FOR SLIPPER CAVITATION EROSION CONTROL AND IMPACT REDUCTION

TECHNICAL FIELD

This invention relates to a slipper and swashplate cavitation erosion control and impact reduction assembly for a piston type hydraulic apparatus.

BACKGROUND ART

In hydraulic piston type units, pistons are caused to slide within bores of a rotating cylinder block and act against a swashplate. In so doing, mechanical energy is transformed into fluid power or conversely fluid power can be converted into mechanical energy by reversing the operation. Simply stated, a hydraulic piston type unit of the type described, may be operated as a pump or as a motor. To accomplish this, it is necessary to transfer fluid pressure from one level to another. Where the hydraulic unit is operated as a pump, fluid pressure is raised from a low level to some higher level, whereas, when the hydraulic unit is operated as a motor, fluid pressure is received at a high level and discharged at a lower level. In both of these types of energy transfer situations, it is necessary that a pressure level change or transition take place approximately each 180° of rotation or twice each revolution. It is at these pressure level changes or transitions that slipper-swashplate interface problems occur. A typical problem is that of impact loading of the slipper on the face of the swashplate evidenced by scuffing of the swashplate by the slipper. Another problem is that of erosion typical of that associated with cavitation. The invention to be described hereinafter provides a simple and efficient remedy for these problems.

Historically the problem of cavitation erosion control has been treated in a number of patents to be discussed hereinafter which employ swashplates, hydraulic pumps and motors. A number of these patents recognize the cavitation erosion problem that exists between the main ports of a valve plate and ports in the face of a rotary mounted cylinder block positioned in sliding engagement with the valve plate provided with the main ports. The main ports of the valve plate are generally of a kidney shape and experience either high or low pressure. Movement of the cylinder block containing pistons, alternately exposes the ports in the cylinder block to either high or low pressure.

The patent to Slimm, U.S. Pat. No. 3,369,458, which is directed to a hydraulic apparatus recognizes that there is a sudden pressure change problem between ports 29, FIG. 1 of a rotary cylinder block 25 and fixed high and low pressure ports 33, 34 in a valve plate. An erosion problem that arises because of the sudden pressure changes is relieved by providing an auxiliary port 54, (FIG. 4) in the fixed valve plate 24. The auxiliary port 54 communicates with restricted flow passages 50 and 55 through a check ball valve 58 (FIG. 2 and FIG. 4) in a bridge 52 between the high and low pressure ports. The Slimm hydraulic apparatus has a slipper 41 but makes no provision for slipper-swashplate erosion control.

The patent to Moon et al U.S. Pat. No. 3,585,901 which is directed to a hydraulic pump, provides for noise reduction at a valve plate 52 and cylinder block 14 port plate 51 interface (FIG. 1). The presence of noise is frequently associated with erosion and cavitation wear problems. Moon et al accomplishes noise reduction by the provision of "fishtails" 76, 86 adjacent the leading edge of high and low pressure ports in the valve plate. The fishtails provide orifices that control the rate of bulk modulus flow. This results in a reduction of wave fronts and a decrease in noise and concomittant wear. Moon et al includes a slipper 34 that has a passage through the slipper 34, not referenced, to provide lubrication to the slipper 34 and swashplate bearing surface interface 32. Moon does not recognize the problem of erosion at the slipper-swashplate interface and entertains no remedy.

The Schauer U.S. Pat. No. 4,096,786, directed to a rotary fluid energy translating device, is in the same class of devices as the patents to Slimm and Moon et al in that noise level reduction is a primary feature of the invention and contemplates the inclusion of structure to reduce the noise level of the device during operation by pressure control within the device during transition between high and low pressure ports of the device and, particularly, by means of employing trapped volumes of fluid to obtain intermediate pressure levels during the transition and by varying the trapped volumes for a controlled rate of pressure change dependent upon the volume of fluid in the device subject to pressure transitions. The Schauer patent neither recognizes the slipper erosion problem nor provides any means that would inherently treat the problem.

The patent to Sperry U.S. Pat. No. 1,714,145, directed to a crankless engine, teaches the use of radial grooves 20 in a slipper ring 15 to provide a lubricant flow path to reduce friction between a slipper ring 15 and swashplate 11 (FIG. 2). Sperry does not provide a lubrication path through the pistons 46 as will be described hereinafter with respect to the subject invention.

The patent to Alexander U.S. Pat. No. 3,996,806, involves a hydrostatic transmission with oscillating output which shows in FIG. 1, a rocker arm 30, that carries a plurality of pistons 40. Each piston is provided with a slipper shoe 54 riding on the surface of a cam plate 14. The cam plate is provided with a plurality of passages 56 that communicate with a balance pad 32 on one side of the cam plate 14 as well as the slipper shoe side. The ball 44 and spring 46 act as a check valve and are involved in the pumping of lubricant to balance pad 32. The pressure on either side of the cam plate 14, i.e. at the slipper interface with cam plate and balance pad with the back of the cam plate, "equalize the load on the front and back of the cam plate" (column 2 lines 3 to 5). The Alexander patent does not feature venting of a slipper to reduce cavitation and erosion wear as taught in the specification that follows.

DISCLOSURE OF INVENTION

This invention relates to a slipper and swashplate cavitation erosion control and impact reduction assembly for a piston type hydraulic apparatus that includes a rotating cylinder block having at least one axially disposed bore. A piston is mounted for reciprocal movement within the bore. A fixed port plate is provided as well as a pair of different fluid pressure sources. The port plate cooperates with the rotating cylinder block to deliver alternately during two discrete and different portions of the cylinder block rotation first one of the fluid pressure sources and then the other of the fluid pressure sources to the bore and the piston.

The piston has at one end thereof a slipper coupled thereto and the slipper is mounted for a sliding interface movement on a surface of a swashplate. The swashplate is nonrotatable in respect of the port plate. The piston has an internal passage extending from one end of the piston to the other end of the piston to thereby allow fluid under alternate pressure to be delivered to and through an opening in the slipper to the interface between the slipper and said swashplate. The inventive improvement resides in the swashplate being provided with at least one vent passage. The vent passage has one end thereof opening at the swashplate surface and the slipper-swashplate interface and the other end of said vent passage opening to an environment in which the ambient pressure is lower than either of the fluid pressure sources to thereby reduced erosion and load impact effects at the slipper-swashplate interface.

It is therefore a primary object of the invention to provide venting of a slipper-swashplate interface to thereby allow energy dissipation and provide reduced cavitation erosion and load impact effects at the slipper-swashplate interface.

Another object of the invention is to provide a swashplate in a hydraulic unit with a pair of vent passages one of which is located in a high pressure region and the other in a low pressure region of the slipper-swashplate interface, to thereby provide for slipper transition into the region without the attendant slipper-swashplate scuffing and cavitation erosion.

In the attainment of the foregoing objects, the invention contemplates a slipper and swashplate assembly for use in piston type hydraulic apparatus.

The swashplate has a surface upon which the slipper interfaces and the slipper is mounted for movement along the swashplate surface. A high pressure source of fluid and a low pressure source of fluid are delivered alternately to and through openings in the slipper to the interface between the slipper and the swashplate.

The swashplate has a pair of vent passages of different sizes. Each of the vent passages has one end thereof opening at the swashplate surface and the slipper-swashplate interface and the other end of the vent passage opening to an environment in which the ambient pressure is lower than either of the fluid pressure sources to thereby allow energy dissipation and provide reduced cavitation erosion and load impact effects at the slipper-swashplate interface.

In the preferred embodiment the larger of the vent passages is associated with the lower of the different pressure sources and the swashplate is characterized by the presence of high and low pressure interface regions as a consequence of the alternate delivery of the high and low pressure fluid.

The vent passage openings are located at or near the entrance end of each of the interface regions with the vent passage opening associated with said high pressure interface region always closer to the entrance end of the interface region than the vent passage opening associated with the low pressure interface region.

Other objects and advantages of the present invention will be apparent upon reference to the accompanying description when taken in conjunction with the following drawings:

BEST MODE FOR CARRYING OUT THE INVENTION

Figure 1:
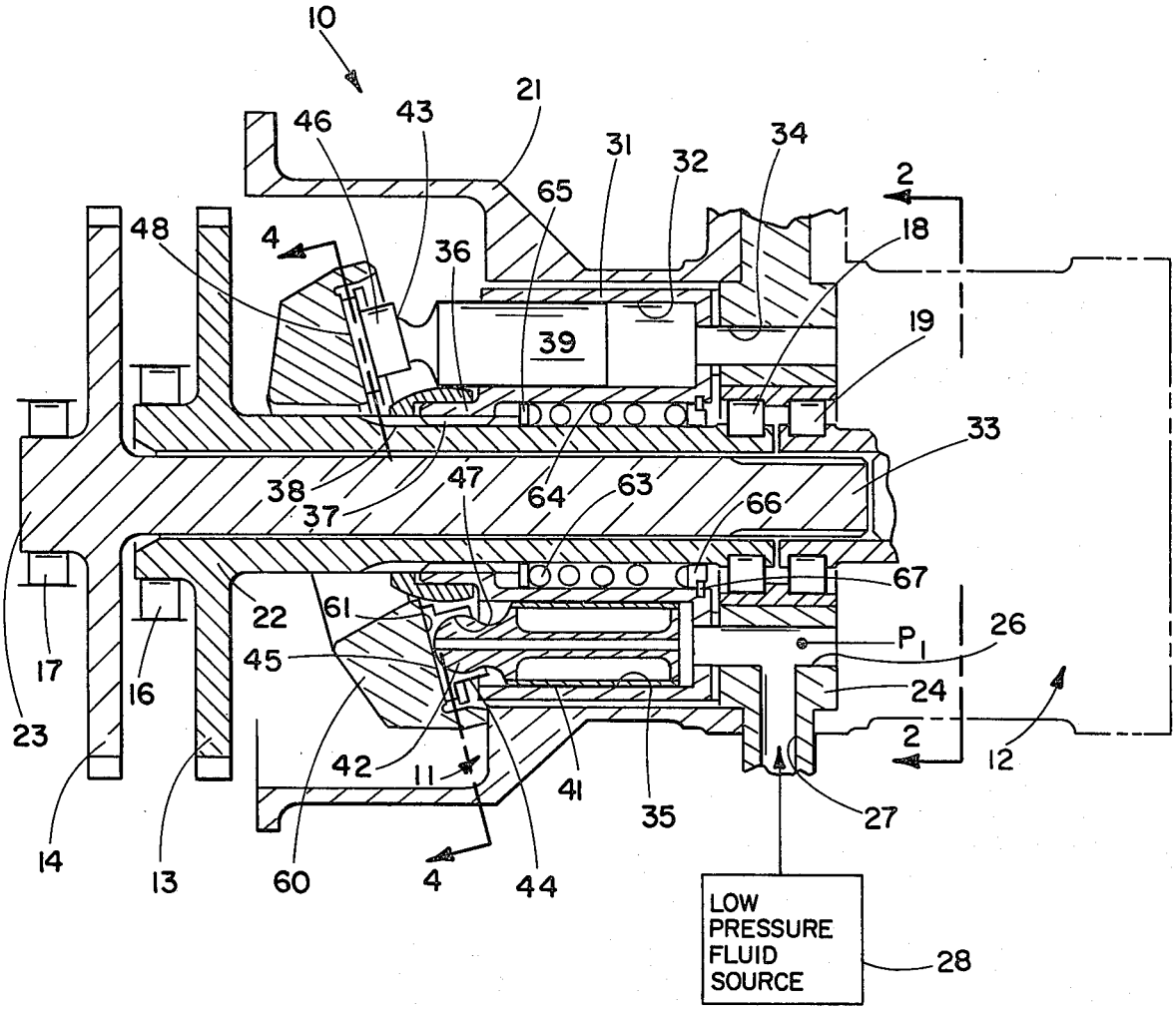
FIG. 1 is a partial cross-section of a hydraulic apparatus that embodies the invention.

Reference is now made to FIG. 1 that illustrates a hydraulic drive 10 particularly suitable for use in a constant speed drive for aircraft, such as that disclosed in the copending Cordner application Ser. No. 932,808, filed Aug. 11, 1978, and assigned to the same assignee as the present invention.

The hydraulic drive 10 consists generally of a variable displacement hydraulic unit 11 and a fixed displacement hydraulic unit 12 shown here in dotted outline. Either of the hydraulic units 11 or 12 may be operated as a pump or a motor depending upon control conditions with the associated constant speed drive. Gears 13 and 14 operate either as input or output gears depending upon displacement of hydraulic unit 11 and the torque transfer in a mechanical differential (not shown) conventionally provided in constant speed drives.

Figure 2:
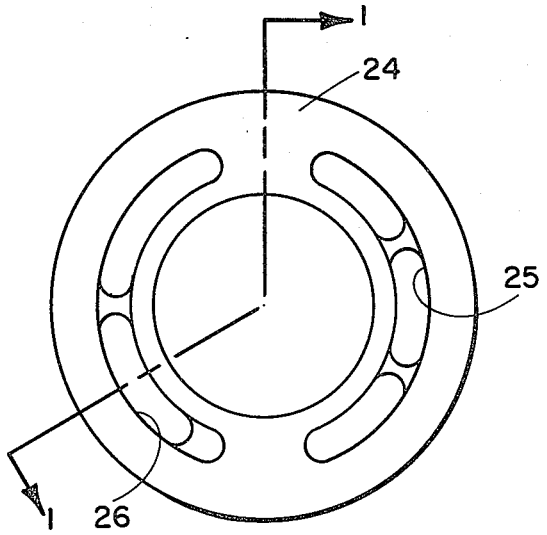
FIG. 2 is a view of a valve member of the hydraulic apparatus of FIG. 1 taken along the line 2—2 in FIG. 1.

Gears 13 and 14 are integral parts of shafts 22 and 23. Shaft 22 is supported on bearings 16 and 18. Shaft 23 is supported by bearings 17 and 19 in the manner shown. These just referred to bearings support the hydraulic unit 11 and 12 within the housing 21. As noted above, gears 13 and 14 and the drive shafts 22 and 23 deliver torque to and from the respective hydraulic units 11 and 12. The drive shafts 22 and 23 are supported at their adjacent ends in roller bearings 18 and 19 seated within a common valve member 24. The valve member 24 has generally arcuate or kidney shaped inlet and discharge passages or ports 25 and 26 as shown in FIG. 2. The section illustrated in FIG. 1 shows only arcuate passage 26, which passage 26 is connected via a conduit 27 to what has been designated as a low pressure fluid source 28. The valve member 24 with its arcuate ports 25, 26, allows for the delivering of fluid in a closed circuit fashion between the hydraulic units 11 and 12.

Hydraulic unit 11 includes a rotary cylinder block 31 with a plurality of axially disposed cylinders bores 32 therein formed in annular array around the axis 33 of shafts 22, 23. Axially disposed cylinders 32 communicate with the ports 25, 26 in valve member 24 through passage 34 at the forward end of the cylinder bores. Formed at the other end of the cylinder block 31 is a central axial annular projection 36 extending rearwardly therefrom and a splined bore 37 therein interengaging splines 38 on drive shaft 22, so that the cylinder block 31 rotates with drive shaft 22 and torque may be transmitted therebetween.

Pistons 39, 41 are reciprocally mounted within each of the cylinder bores 32, 35. The piston 39 has a spherically projecting end 43 and the piston 41 has a spherically projecting end 42. Projecting end 42 carries a slipper 44, and projecting end 43 carries a slipper 46.

Figure 3:
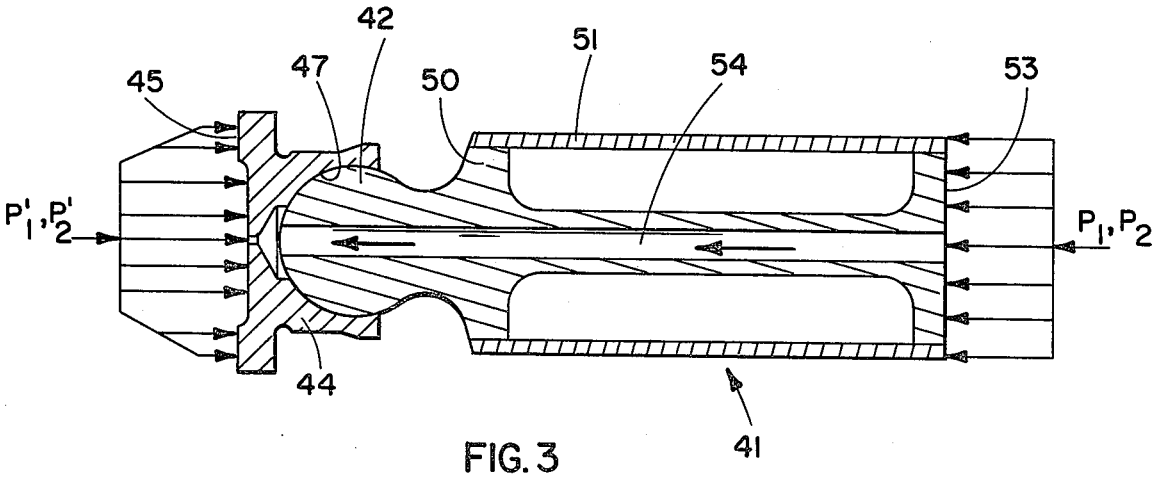
FIG. 3 is a longitudinal cross section of a piston and slipper assembly employed in the hydraulic apparatus of FIG. 1.

Each of the slippers 44, 46 has a spherical socket 47 such as shown in detail in the longitudinal section of FIG. 3, in respect of piston 41. The spherical socket 47 in cooperation with the spherical end 42 allows for pivotal movement therebetween. Each of the slippers 44, 46 have bearing surfaces 45, 48. These slipper bearing surfaces 45, 48 slidably engage a swashplate or cam surface 61 of a swashplate or cam member 60.

The swashplate or cam 60 which produces reciprocating motion of the pistons 39, 41 is pivotally mounted by trunnions (not shown).

Reference is now made to FIG. 3 wherein the piston 41 is shown in greater detail. The piston 41 is seen to consist generally of an integral elongated body member 50 surrounded by a cylindrical cover member 51. The integral body member 50 is generally cylindrical and has a flat radial surface 53 at one end thereof which constitutes a major portion of the working face of the piston 41. As noted earlier, in the other end of the integral body member 50 the spherical projection end 42 is formed. Much of the force of the fluid in the cylinder bores 32, 35 is transferred through the integral body member 50 to the swashplate or cam member 60 as shown in FIG. 1.

A fluid passage 54 is centrally disposed in the generally cylindrical body 50 and opens at one end to the radial surface 53 and at the other end to the spherical surface of the projection end 42 as can best be seen in FIG. 3.

The piston 41 and slipper 44 assembly of FIG. 3 illustrates at the right hand end thereof the presence of fluid under pressure, $P_1$ or $P_2$ as evidenced by the arrows directed to the radial surface 53. At the left hand end of the piston 41 and slipper 44 assembly, there is illustrated fluid under pressure $P_1'$ or $P_2'$ as evidenced by the arrows directed to the slipper bearing surface 45. Pressure $P_1'$ and $P_2'$ at the slipper 44 end are slightly less than $P_1$ and $P_2$ due to the pressure drop through the internal passage 54 and orifice as shown. As the cylinder block 31 of FIG. 1 rotates about its axis, the pressure in the axially disposed cylinder bores 32 and 35 will change from $P_1$ to $P_2$ and then back to $P_1$ during each revolution of the cylinder block. This pressure change, as the piston portion moves across the surface areas 70, 71 of the swashplate surface 61 can best be appreciated by a review of the illustration of FIG. 4.

Figure 4:
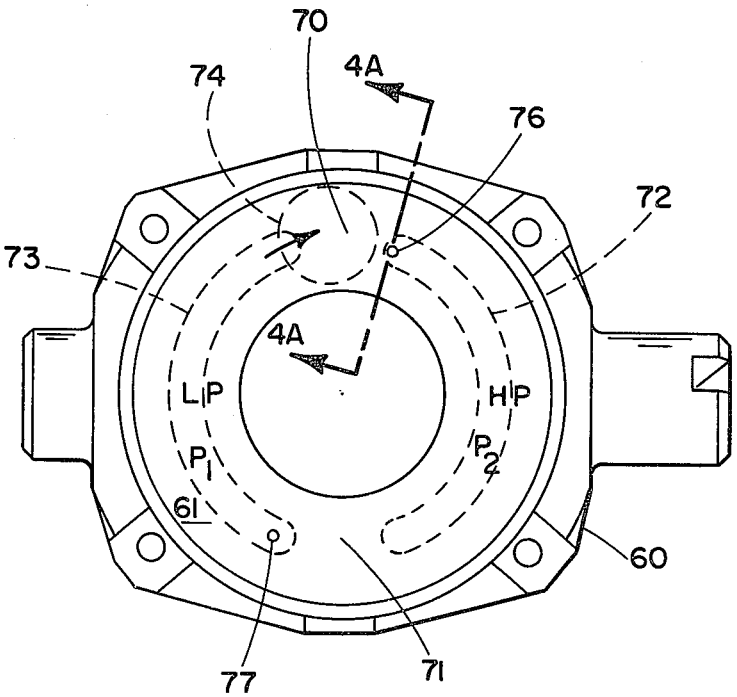
FIG. 4 is a view of the swashplate embodying the invention of the hydraulic apparatus of FIG. 1 taken along the line 4—4 in FIG. 1 shown with the slippers removed.

Referring back to FIG. 1, and keeping in mind FIG. 4, it can be seen that as the cylinder block 31 rotates with respect to swashplate 60, fluid enters the cylinders associated with the pistons moving down the swashplate surface 61 from one of the ports in the valve member 24, and fluid is expelled from the cylinders associated with the ports moving up the swashplate surface 61 to the other port in the valve member 24. The fluid entering or leaving the cylinders may be either high or low pressure fluid. A coil compression spring 63 is provided for resiliently biasing the cylinder block 31 into engagement with the valve member 24 to maintain an effective sliding seal therebetween. Spring 63 surrounds the drive shaft 22 and is received within a central recess 64 in the cylinder block 31. One end of the spring 63 engages a spring seat washer 65 which in turn is restrained against axial movement by a shoulder defined by the inner ends of splines 38 on the drive shaft 22. In this manner the spring 63 reacts against the drive shaft 22 and through bearing 16 to the drive housing. The other end of spring 63 engages an annular spring seat 66, axially fixed with respect to the cylinder block 31 by a suitable snap ring 67 in a groove not referenced in central recess 64. In this manner, the spring 63 resiliently urges the cylinder block 31 into engagement with the valve member 24.

In FIG. 4 the view of swashplate or cam 60 reveals the swashplate surface 61 on which there is shown in dotted outline arcuate kidney shaped interface regions 72, 73 defining discrete and different portions that correspond with high or low pressure provided by kidney shaped arcuate high pressure port 25 and kidney shaped arcuate low pressure port 26 as shown in FIG. 2.

The outline 74 of a slipper is also shown in dotted outline moving from a low pressure (LP) $P_1$ interface region 73 into the surface space 70 adjacent high pressure (HP) $P_2$ interface region 72.

The pressure change as noted earlier as a slipper moves from one region 73 to another region 72 taking place rather abruptly, i.e. in microseconds, producing erosion and/or impact loading. In accordance with the invention, locating energy dissipating orifices or openings 76, 77 in the swashplate face where the pressure transitions occur, prevents the detrimental effects of both erosion and impact loads. The location and size of the orifices 76, 77 is as shown in FIG. 4 and these are for a unit which performs either as a pump or a motor. It should be understood that in the practice of the invention, the vent opening or orifice 77 associated with the lower of the pressure sources, $P_1'$ is larger than the orifice 76 associated with the high pressure source $P_2'$. It is also important in the practice of the invention that in order to obtain optimum results, the vent passage or orifice 76 associated with the high pressure $P_2'$ interface region 72 be always closer to the entrance end of the high pressure interface region than the vent passage opening or orifice 77 associated with the low pressure $P_1'$ interface region 73.

Figure 4A:
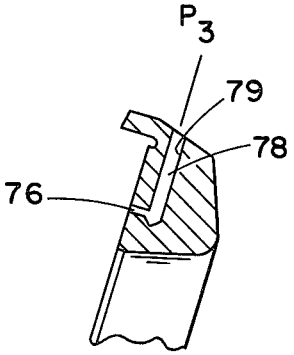
FIG. 4A is a cross-sectional view taken along the line 4A—4A of FIG. 4.

In FIG. 4A the section shown illustrates how the orifice 76 or vent opening as it may be termed, connects with a passageway 78 which passageway opens at 79 to an ambient pressure $P_3$ which is lower than either $P_1$, $P_2$ or $P_1'$, $P_2'$. The abmient pressure $P_3$ is the internal pressure of the enclosure in which the hydraulic unit is mounted.

The use of each of the vents or orifices 76, 77 differs in achieving resolution of the problem. In operation, when the cylinder block of FIG. 1 is rotating in a clockwise direction as is indicated by slipper dotted outline 74 in FIG. 4, the pistons 39, 41 in the cylinder block will, in succession, move from communicating with the low pressure (LP-$P_1$) porting kidney 26 in the valve member 24 to having access with the high pressure (HP-$P_2$) porting kidney 25. When communication is made with the HP-$P_2$ porting kidney 25, the piston and cylinder bore are sealed from the LP-$P_1$, porting kidney 26. This produces a sharp rise in pressure at the flat radial surface 53 of the piston 41, as well as, in the communicating passage 54 in the center of the piston 41 and at the slipper face 45 and an impact load results at the slipper 44 and swashplate surface 61. An additional effect to be considered is the collapsing or implosion of minute voids in the fluid which exist due to entrained gases. This implosion produces erosion of the surfaces containing the volume of fluid held between the slipper surface 45 and swashplate surface 61. The effect of impact and erosion can best be seen by the wear or scuff mark 79 in the prior art swashplate of FIG. 5. The high pressure vent or orifice 76 and passageway 78 allows this volume of fluid to communicate to a volume of fluid at the lower pressure, $P_3$, as shown in FIG. 4A. This venting dissipates a sufficient amount of energy to prevent any of the deleterious erosion wear and dampen the impact effect.

The location of the low pressure vent or orifice 77 is in the proximity of 180° of arc from high pressure vent 76. A discussion of the size of each orifice has been set forth hereinbefore. As the slipper moves from the high pressure interface region 72 and across the surface area 71 and enters the low pressure interface region 73, another pressure transition takes place. The pistons 39, 41 in the cylinder block 31 will, in succession, move from communicating with the high pressure kidney shaped port 25 in the valve member 24 to making communication with the low pressure kidney shaped port 26. When communication is made with the low pressure kidney shaped port, the piston and bore are sealed from the high pressure kidney shaped port 25, and a sharp drop in pressure occurs at the flat radial surface 53 of the piston 41 in the communicating passage 54 in the center of the piston 41, and at the slipper face 45. Impact loading and cavitation follow this pressure transition in the form of dynamic instabilities.

At this point, the sequence of events differ from that which occurs with orifice or vent 76. Normally, impact loading and cavitation,erosion do not occur when transitioning to a lower pressure. The problem develops because the piston 41 slipper 44 assembly and the fluid act as a spring mass system. When the end pressure is quickly changed, as it occurs here, the result is likened to releasing a preloaded spring mass system; the inertia causes the spring to go beyond its free state dimension. If the spring mass system is in compression prior to release, inertia will cause it to extend upon release past the free state length, momentarily, into a state of tension. One or more oscillations may occur before the system comes to rest. In a hydraulic environment, this over extension results in a momentary low pressure or possibly a partial vacuum lower than the $P_1$ pressure. Bubble growth and subsequent cavitation bubble collapse are inherent in this mechanism. When the fluid pressure under the slipper bearing surface or face returns to $P_1'$, it does so very quickly producing cavitation erosion.

Figure 5:
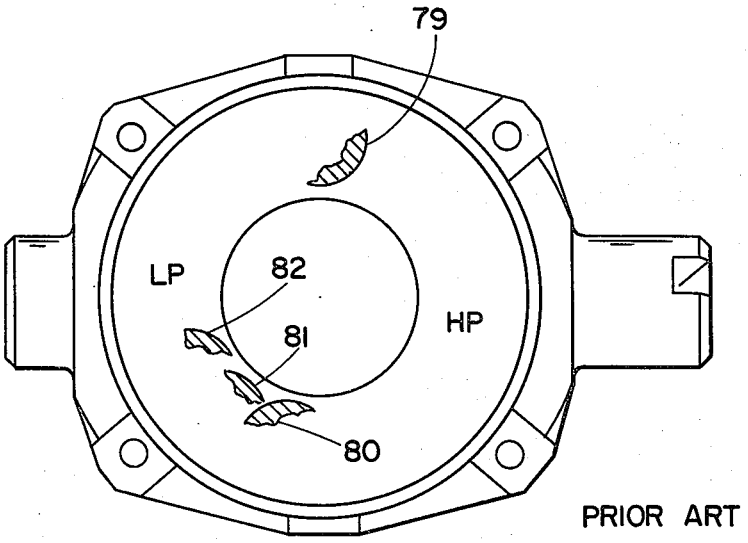
FIG. 5 is a view of a prior art swashplate that does not contain the invention and evidences impact loading wear as well as cavitation erosion scuffing.

FIG. 5 illustrates the erosion and impact loading wear that appears as a consequence of this movement. The series of scuff or wear marks 80, 81, 82 indicate that the system oscillates several times before a state of rest occurs. Each oscillation produces an impacting of the slipper on the swashplate face or surface 61.

The installation of the vent or orifice 77 eliminates the formation of an extremely low pressure area preventing cavitation erosion and also provides a dampening effect thereby preventing the aforementioned oscillations and attendant adverse wear problems.

Although this invention has been illustrated and described in connection with the particular embodiment illustrated, it will be apparent to those skilled in the art that various changes may be made therein without departing from the spirit of the invention as set forth in the appended claims.

I claim:

1. A slipper and swashplate for use in piston type hydraulic apparatus, the combination including:

said swashplate having a surface upon which said slipper interfaces, said slipper mounted for movement along said swashplate surface, a high fluid pressure source and a low fluid pressure source delivered alternately to and through openings in said slipper and said swashplate, said swashplate including a pair of vent passages, each of said vent passages having one end thereof opening at said swashplate surface and said slipper-swashplate interface and the other end of said vent passage opening to an environment in which the ambient pressure is lower than either of said fluid pressure sources to thereby allow energy dissipation and provide reduced cavitation erosion and load impact effects at said slipper-swashplate interface, said swashplate having high and low pressure interface regions as a consequence of said alternate delivery of said high and low pressure fluid, said vent passage openings being located at the entrance end of each of said interface regions.

2. The combination of claim 1 wherein said vent passages are of different sizes.

3. The combination of claim 2 wherein the larger of said vent passages is associated with the low fluid pressure source.

4. The combination of claim 3 wherein said vent passage opening associated with said high pressure interface region is always closer to said entrance end of said interface region than said vent passage opening associated with said low pressure interface region.

* * * * *